US005579744A

United States Patent [19]

Trefz

[11] Patent Number: 5,579,744

[45] Date of Patent: Dec. 3, 1996

[54] CRANKCASE VENTILATOR FOR INTERNAL COMBUSTION ENGINES

[75] Inventor: Walter Trefz, Backnang, Germany

[73] Assignee: Filterwerk Mann & Hummel GmbH, Ludwigsburg, Germany

[21] Appl. No.: 497,449

[22] Filed: Jun. 30, 1995

[30] Foreign Application Priority Data

Jul. 2, 1994 [DE] Germany ..... 94 10 668.1

[51] Int. Cl.[6] ..... F01M 13/04

[52] U.S. Cl. ..... 123/573

[58] Field of Search ..... 123/572, 573, 123/574, 41.86; 55/322, 423, 337

[56] References Cited

U.S. PATENT DOCUMENTS

| | | | |
|---|---|---|---|
| 2,387,208 | 10/1945 | Wood . | |
| 2,731,958 | 1/1956 | Robley | 123/573 |
| 4,993,517 | 2/1991 | Leipelt et al. . | |
| 5,205,848 | 4/1993 | Blanc et al. . | |
| 5,239,972 | 8/1993 | Takeyama et al. | 123/573 |
| 5,450,835 | 9/1995 | Wagner | 123/573 |

FOREIGN PATENT DOCUMENTS

| | | | |
|---|---|---|---|
| 395841 | 11/1990 | European Pat. Off. . | |
| 506571 | 9/1992 | European Pat. Off. . | |
| 1413201 | 8/1965 | France . | |
| 1268902 | 5/1968 | Germany . | |
| 3107191 | 6/1982 | Germany | 123/573 |
| 613386 | 11/1948 | United Kingdom . | |

*Primary Examiner*—Marguerite McMahon

*Attorney, Agent, or Firm*—Evenson, McKeown, Edwards & Lenahan P.L.L.C.

[57] ABSTRACT

A crankcase ventilating system for an internal combustion engine includes a vent line issuing from the crankcase and connected to a liquid separator. The liquid separator has a collecting chamber for separated liquid and at least two drain lines returning to the crankcase. The liquid separator also has a connection leading to the vacuum line of the internal combustion engine.

6 Claims, 1 Drawing Sheet

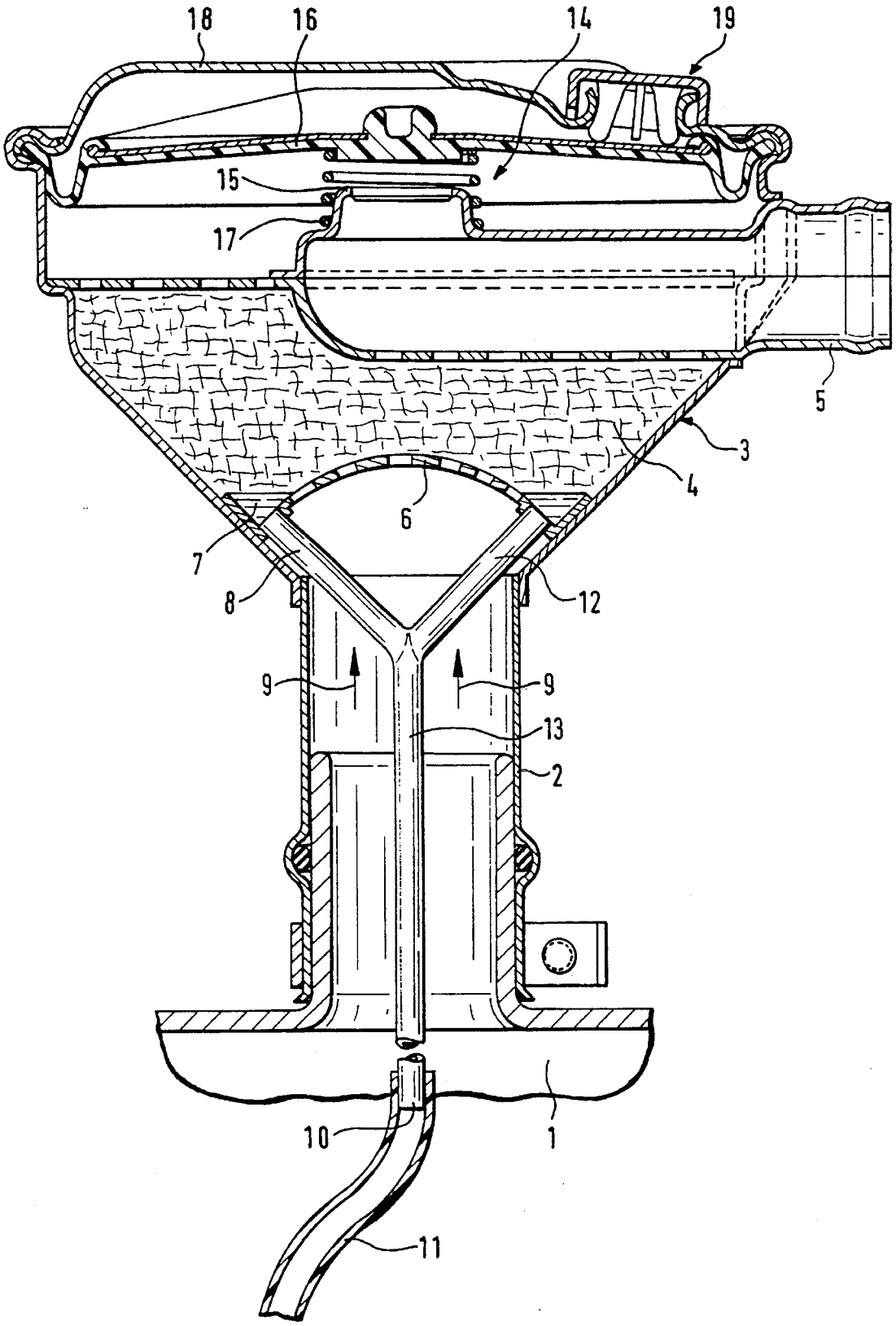
18
16
14
19
15
17
5
3
4
6
7
8
12
9
9
13
2
10
1
11

CRANKCASE VENTILATOR FOR INTERNAL COMBUSTION ENGINES

BACKGROUND OF THE INVENTION

This invention relates to a crankcase ventilator for an internal combustion engine, having a liquid separator in communication with the crankcase via a vent line and in communication with the vacuum line of the engine.

It is known to draw off the oil vapor from the crankcase of an internal combustion engine, and to filter it and cool it, in order to recover the oil.

German Patent document DE-AS 12 68 902 describes a known crankcase ventilator for internal combustion engines. From a vent opening on the crankcase a connecting duct leads upward to a vacuum connection. A condensate settling chamber with a filter mesh is disposed in the connecting duct, and a drain tube with a shut-off valve leads into the open air. The separated oil flows directly along the wall of the vent connection, back into the crankcase. However, in the event of a fairly high gas velocity in the ventilating connection the oil is prevented from flowing back. It is carried along by the gas stream into the vacuum connection and enters into the combustion process.

Furthermore, German Patent document DE-OS 31 07 191 provides a drain line in the interior of the ventilation duct, through which the liquid is carried from the collecting chamber into the crankcase. This drain tube, however, is reliable in operation only if the collecting chamber is in an exact horizontal position, such that the liquid is evenly distributed around the collecting chamber. In internal combustion engines for motor vehicles equipped with such crankcase ventilation, however, the horizontal position is not always maintained. Therefore a fairly large amount of liquid can accumulate in the collecting chamber and cannot be reliably returned to the crankcase. This liquid is entrained in the case of a comparatively high gas velocity and thus can enter the combustion process.

SUMMARY OF THE INVENTION

The object of the present invention is to overcome the above-mentioned disadvantages by providing a crankcase ventilator which will function reliably in internal combustion engines for motor vehicles.

This object has been achieved by providing a crankcase ventilator for internal combustion engines which includes a liquid separator connected with the vacuum line of the internal combustion engine. The liquid separator has a collecting chamber for separated liquid. A vent line communicates the liquid separator with the crankcase. Two outlet lines arranged substantially diametrically opposite each other communicate the collecting chamber with the crankcase. In a further embodiment, more than two outlet lines are provided, which are disposed at various positions in the collecting chamber.

A particular advantage of the present invention is that the arrangement of a plurality of connections and drain lines in the collecting chamber ensures reliable drainage of the collected oil.

According to a further embodiment of the invention, the individual drain lines lead into a common line which then runs back inside of the vent line into the crankcase.

According to a further advantageous embodiment, a trough for the separated liquid is provided with connections to which the drain lines can be connected.

These and additional features of preferred embodiments of the invention are found in the specification and the drawings. It is to be understood that the individual characteristics may be implemented separately or combined, and may represent advantageous as well as separately patentable constructions.

Other objects, advantages and novel features of the present invention will become apparent from the following detailed description of the invention when considered in conjunction with the accompanying drawings.

BRIEF DESCRIPTION OF THE DRAWING

The drawing is a sectional view of a crankcase ventilator for an internal combustion engine.

DETAILED DESCRIPTION OF PREFERRED EMBODIMENTS

The crankcase ventilator according to the drawing consists of a vent 2 issuing from a crankcase 1, and of a funnel-shaped liquid separator 3 with a separator packing 4, as well as a vacuum line 5 leading to the air inlet side of a piston engine that is not shown. In the liquid separator 3 a bottom sieve 6 of appropriate shape forms a chamber 7 in the form of a trough for collecting separated liquid. This trough is situated in the area of the transition from the liquid separator 3 into the vent 2. A drain line 8 runs from this trough in the inside of the vent 2 back into the crankcase 1. In this manner the separated, returning oil is segregated from the upwardly flowing ventilation gases 9 and does not come into contact with them. If necessary, a hose 11, preferably of an oil-resistant plastic, is pushed over the end 10 of the drain line within the crankcase 1. The hose 11 runs to a non-turbulent zone inside the crankcase 1.

An additional drain line 12 is provided diametrically opposite the first drain line 8. Of course it is possible and advantageous to provide three, four, or more drain lines. This will assure that the liquid in collecting chamber 7 will flow out of the oil separator regardless of the position of the collecting chamber relative to horizontal.

All drain lines lead into a common drain line 13 which, as already stated, can be connected to a hose 11.

In the oil separator there is a valve 14 which limits the vacuum from the vacuum line. This valve consists of a valve seat 15, a valve element 16 which is formed of an elastic material such as rubber, and a spring 17. In case of a very high vacuum in the vacuum line 5, the valve element 16 moves downward against the force of the spring 17 and closes or reduces the passage cross section of the oil separator, so that an unacceptably high vacuum cannot propagate all the way into the crankcase.

In the cover 18 of the oil separator there is a diaphragm venting valve 19. This valve has the purpose of letting air into and out of the space above the diaphragm 16.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A crankcase ventilator for an internal combustion engine comprising:

a liquid separator connected with a vacuum line of the internal combustion engine and having a collecting chamber for separated liquid;

a vent line communicating the liquid separator with a crankcase; and first and second outlet lines communicating the collecting chamber with the crankcase, said outlet lines being arranged substantially diametrically opposite each other.

2. A crankcase ventilator according to claim 1, wherein the first and second outlet lines lead into a common drain line.

3. A crankcase ventilator according to claim 1, wherein the collecting chamber comprises an annular trough, and said first and second outlet lines are connected to outlet openings in said annular trough.

4. A crankcase ventilator for an internal combustion engine comprising:

a liquid separator connected with a vacuum line of the internal combustion engine and having a collecting chamber for separated liquid;

a vent line communicating the liquid separator with a crankcase;

at least three outlet lines communicating the collecting chamber with the crankcase, said at least three outlet lines being disposed at various positions in the collecting chamber.

5. A crankcase ventilator according to claim 4, wherein the at least three outlet lines lead into a common drain line.

6. A crankcase ventilator according to claim 4, wherein the collecting chamber comprises an annular trough, and said at least three outlet lines are connected to outlet openings in said annular trough.

* * * * *